US009691100B2

(12) United States Patent
Wolfsen

(10) Patent No.: US 9,691,100 B2
(45) Date of Patent: Jun. 27, 2017

(54) AUTO AUCTION ARENA

(71) Applicant: Robert Wolfsen, Chandler, AZ (US)

(72) Inventor: Robert Wolfsen, Chandler, AZ (US)

( * ) Notice: Subject to any disclaimer, the term of this patent is extended or adjusted under 35 U.S.C. 154(b) by 0 days.

(21) Appl. No.: 14/820,878

(22) Filed: Aug. 7, 2015

(65) Prior Publication Data

US 2017/0039635 A1 Feb. 9, 2017

(51) Int. Cl.
*G06Q 30/08* (2012.01)

(52) U.S. Cl.
CPC ..... *G06Q 30/08* (2013.01)

(58) Field of Classification Search
CPC .... E04H 3/22; E04H 3/10; E04H 3/26; E04H 14/00; E04H 1/005; E04H 3/00; E04H 3/04; E04H 3/14; E04H 5/02; G06Q 30/08
USPC ..... 52/174, 175, 176, 33, 36.1, 36.2, 234; 186/35, 36, 40, 41, 45, 52, 53
See application file for complete search history.

(56) References Cited

U.S. PATENT DOCUMENTS 1,091,484 A * 3/1914 Cohn ..... A63C 19/10 104/60
1,850,490 A * 3/1932 Bahl ..... B64F 1/00 244/114 R
2,400,841 A * 5/1946 Rogers ..... B64F 1/00 244/114 R
2,405,294 A * 8/1946 Delucchi ..... 186/41
2,550,480 A * 4/1951 Hubbard ..... A63B 69/3691 472/92
2,560,480 A 4/1951 Hubbard
2,638,636 A * 5/1953 Pool ..... E04H 3/04 186/53
2,743,827 A * 5/1956 Winokur et al. ..... B65G 37/00 186/62
2,895,179 A * 7/1959 Wilson ..... A63J 25/00 52/175
3,115,684 A * 12/1963 Joy ..... E04H 3/26 52/236.2
3,290,837 A * 12/1966 Weston ..... E04H 3/00 52/175
3,436,879 A * 4/1969 Duke ..... E04H 1/1272 40/584
3,451,261 A * 6/1969 Olsen ..... G01M 15/02 52/174
3,466,817 A * 9/1969 Hagel ..... E04H 1/04 52/176
3,487,595 A * 1/1970 Schumann ..... E04H 3/10 52/236.2
3,572,619 A * 3/1971 Brown ..... B64F 1/00 244/114 R
3,774,723 A * 11/1973 Johnston ..... E04H 14/00 137/234.6
3,810,705 A * 5/1974 Warriner ..... E04H 14/00 404/1

(Continued)

*Primary Examiner* — James Ference
(74) *Attorney, Agent, or Firm* — Venjuris, P.C.

(57) ABSTRACT

An improved auto auction layout places all active auctions within sight of a centralized location. Three or more auctioneer stations placed near the perimeter of the centralized location each correspond to an auto auction lane. Even as lanes independently advance through cars at varying rates, the improved layouts enables bidders and consigners to monitor both the lane with which they are actively engaged and all other lanes, or to participate in multiple simultaneous auctions.

6 Claims, 5 Drawing Sheets

(56) References Cited

U.S. PATENT DOCUMENTS 4,010,824 A * 3/1977 Bavis ..... E04H 14/00 186/37
4,311,211 A * 1/1982 Benjamin ..... G07F 7/04 104/302
4,733,754 A * 3/1988 Acosta ..... A47F 10/00 186/41
4,805,738 A * 2/1989 Vayda ..... B65G 1/1378 186/36
4,884,662 A * 12/1989 Cho ..... E04H 3/04 186/36
4,901,482 A * 2/1990 Lockard ..... E04H 3/04 52/169.2
4,953,326 A * 9/1990 Wexler ..... E04H 14/00 186/37
5,081,803 A * 1/1992 Jackson ..... E04H 3/14 52/169.2
5,109,956 A * 5/1992 Casale ..... A47J 27/14 186/41
5,113,970 A * 5/1992 Bavis ..... A47F 10/06 186/41
5,158,155 A * 10/1992 Domain ..... E04H 3/02 186/53
5,168,961 A * 12/1992 Schneider ..... G07G 1/0036 186/52
5,234,305 A * 8/1993 Hotta ..... E04H 6/10 414/228
5,361,891 A * 11/1994 Greene ..... B65G 19/02 186/37
5,765,314 A * 6/1998 Giglio ..... E04H 3/22 472/75
6,164,018 A * 12/2000 Runge ..... E04H 3/22 52/174
6,164,491 A * 12/2000 Bustos ..... E04H 3/02 186/53
6,253,494 B1 * 7/2001 Shaffron ..... E04H 3/26 52/64
6,253,956 B1 * 7/2001 Khan ..... G07F 11/16 186/53
6,293,052 B1 * 9/2001 Varnado, Jr. ..... E04H 3/22 52/7
7,024,378 B2 * 4/2006 Razumov ..... G06Q 20/203 186/53
7,349,870 B1 * 3/2008 Mahoney ..... G06Q 30/08 705/26.3
7,722,454 B2 * 5/2010 Thompson ..... G06Q 30/02 340/928
7,784,228 B2 * 8/2010 Gustafson ..... E04H 6/10 414/228
7,806,316 B1 * 10/2010 Torres ..... G07F 19/20 235/379
7,980,858 B2 * 7/2011 Valoe ..... E04H 3/08 434/432
2002/0046518 A1 * 4/2002 Eguchi ..... E04H 1/005 52/220.1
2004/0123533 A1 * 7/2004 Petroski ..... E04H 3/04 52/174
2004/0249497 A1 * 12/2004 Saigh ..... E04H 14/00 700/216
2006/0076397 A1 * 4/2006 Langos ..... G06Q 10/087 235/375
2006/0245859 A1 * 11/2006 Frank ..... E04H 6/14 414/277
2007/0000185 A1 * 1/2007 DeLine ..... E04H 3/14 52/33
2007/0187183 A1 * 8/2007 Saigh ..... E04H 14/00 186/53
2007/0193123 A1 * 8/2007 Magpuri ..... E04H 3/22 52/8
2007/0260473 A1 * 11/2007 Cornacchia ..... E04H 1/04 705/313
2008/0127574 A1 * 6/2008 Yi ..... E04H 6/10 52/8
2008/0177629 A1 * 7/2008 Higgs ..... E04H 3/02 705/14.23
2009/0255195 A1 * 10/2009 Bridgman ..... E04H 14/00 52/174
2011/0108363 A1 * 5/2011 Sherman ..... E04H 3/02 186/36
2011/0128381 A1 * 6/2011 Bianco ..... G07B 15/02 348/149

* cited by examiner

40

A-A

AUTO AUCTION ARENA

FIELD OF INVENTION

This invention generally relates to automobile auctions and, more particularly, is related to a facility designed for conducting automobile auctions in a more economically efficient manner.

BACKGROUND

Auto auctions have been taking place for at least seventy-five years. During that time, technological advances have improved the efficiency and operability of the auto auction. But comparatively little has changed with respect to the layout of the auction arena itself. As auctions have grown, their venues have grown accordingly without otherwise introducing significant changes to their layout. The largest auto auction arena in the U.S. is located in Manheim, Pa.; it has 33 lanes spread out over a length of more than 600 feet.

FIG. 1 illustrates a plan view of a typical prior art auto auction arena. As shown, the typical prior art auto action arena 10 is housed in a walled building 12. Within the walled building 12 is a plurality of auto lanes 14. The auto lanes 14 run parallel to each other and each lane runs straight through the walled building 12 through openings 16 (i.e., doors) in the walls.

Auction bidders stand in bidder areas 16 between the lanes 14. As shown, the bidder areas 16 are bounded on opposite sides by auto lanes 14 and on the adjacent sides by the building walls 12. On one end of the bidding area 16 are auctioneer stands 22. One auctioneer is assigned for each auto lane 14.

In operation, cars 400 to be auctioned enter the building and drive down the auto lanes 14 toward the auctioneer stands 22. When the cars get to the auctioneer stand 22, the auctioneer that lanes auctions off the car, after which the car is driven out of the building so the next car in line can move up and be auctioned. All lanes conduct auctions at the same time.

The traditional prior art floorplan as just described presents problems to bidders on the floor. The arenas must move cars in, conduct bids, sell the cars, then bring in the next car as quickly as possible to minimize operating expenses and maximize profit, often leaving bidders no time to move between an auction in one lane and another auction in another lane. Each lane advances from one car to the next as quickly as each auction is completed, and any given lane may advance faster or slower than the other lanes. Bidders who choose to stay and bid on a car in one lane lose the ability to bid on other cars in other lanes. This disadvantage is particularly acute for solo bidders, who cannot know how many auctions have been completed in other lanes. These bidders must decide on the spot whether to stay with a particular auction or to abandon it for a more favorable one in a distant lane; sometimes, bidders abandon one auction in hopes of bidding on a more desired car in another lane, only to discover it has already been sold.

The traditional layout also creates problems for the consigners who are trying to sell cars through the arena. Certain lanes are seen as more desirable than others because of their relative distance from the main entry doors. Moreover, consigners prefer to represent their cars on-site because they have a better chance of making a sale. Consigners who can interact with the bidders often get a better price. Conversely, consigners on site may choose to authorize a lower price floor for one of their cars due to lack of bids, rather than letting the car go unsold. Bidders are also more interested in groups of cars which are represented by the consigners. When a consigner's cars are spread out over multiple lanes, consigners lose the ability to represent all of their cars and consequently lose money. They may choose to focus their efforts on the more favorable lanes close to the arena exit to the detriment of their other auctions.

The arena itself loses potential profits when bidders and consigners face these problems. Because the house takes a share of the proceeds from every successful auction, it is in the house's best interests to ensure that every potential bidder is involved in as many auctions as they are willing to participate in. However, arenas are constrained by time available to run the auctions. Idle time on the lanes costs the arenas money in operating costs; this is one reason that auctions tend to progress as fast as the house can make them progress. While time and operating expenses will always be a constraint, the traditional auto auction arena floorplan exacerbates these constraints to the detriment of bidders, consigners, and auction houses. Therefore, a heretofore unaddressed need exists in the industry to address the aforementioned deficiencies and inadequacies.

SUMMARY

For the purposes of this specification, the words "car", "automobile", or "auto" include any type of automobile, including cars, trucks, motorcycles, and other wheeled vehicles whether driven either by internal combustion engines, hybrid engines, electric motors, or other means.

The present invention provides a structure suitable for conducting automobile auctions in the form of an improved auto auction arena. The layout of the features in this improved auto auction arena consolidates operational space into a central bidders' area, eschewing the practice of spreading out the arena over a wide area in favor of bringing each car to an outer edge of the central bidders' area. This structure places bidders, consigners, auctioneers, and all cars up for auction within sight of one another, easing their interaction to facilitate higher profits and greater access to desired cars. Bidders and consigners may move freely from one auction to the next, while the arena's structure aids each participant's strategic participation in the auctions.

During an auction, the layout enables the auction house managers to bring each car to the central bidders' area in turn, preferably by driving the cars single-file along one of the approaching one-way lanes up to the edge of the central bidding area. The lane leads from outside of the auction arena up to the perimeter of the central area, then away again. Cars move along a given lane until the one currently up for auction is in front of its corresponding auctioneer station, where it remains until auction is complete and the auctioneer is prepared for the next car. At that time, the car would continue along the one-way lane away from the arena and to its lot until it could be picked up. These lanes may be built to intersect the perimeter of the central bidders' area and cross through the central bidders' area itself before intersecting the perimeter again and exiting the arena, intersect the perimeter of the central bidders' area and run collinear to said perimeter for a time before splitting away, or curve tangentially to the central bidders' area and intersect its perimeter at a single point before immediately curving away.

Embodiments of the present invention enable increased participation in auto auctions by enabling bidders and consigners to monitor multiple auction lanes from the same location, effectively removing barriers to economic action and increasing corresponding economic efficiency. In turn, increased economic efficiency in the auctions increases arena profits by ensuring that every car can be seen by all of its highest potential bidders. Embodiments narrow the competitive advantage of large groups of bidders over independent solo bidders; the solo bidders are able to see all current auctions in progress and choose the one that is best for them rather than guessing whether a distant auction is better than the one the sole bidder is currently closest to. In other words, regardless of where they are located within the central bidders' area, a solo bidder can view all auctions in progress. The features of the present layout thus make auto auctions more attractive to sole bidders, potentially attracting more sole bidders to each lane.

Further embodiments of the present invention utilize multiple arenas in close proximity to one another. These embodiments allow auction houses to sort lanes by category, whether that category is price, manufacturer, or any other criteria. Arenas beyond the first may be constructed of the same size and with the same number of auctioneer stations as the first arena, or of a different size and with a greater or lesser number of auctioneer stations depending on the available space and the needs of the auction house.

The features, functions, and advantages may be achieved independently in various embodiments of the disclosure or may be combined in yet other embodiments. It is intended that all such additional features, functions, and advantages be included with this description, be within the scope of the present invention, and be protected by the accompanying claims.

BRIEF DESCRIPTION OF THE DRAWINGS

Embodiments of the disclosure will become more fully understood from the detailed description and the accompanying drawings, wherein.

DETAILED DESCRIPTION

Figure 1:
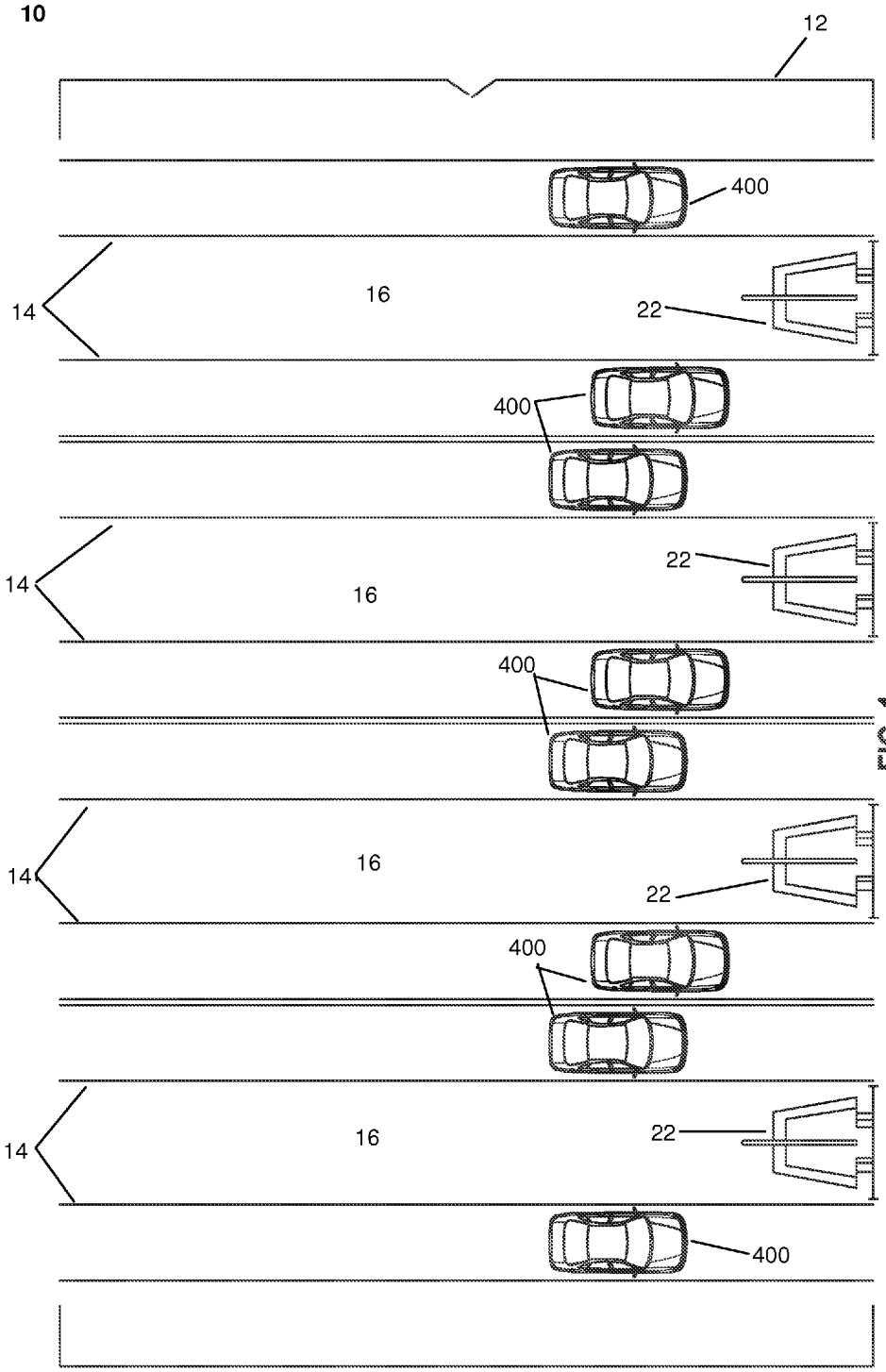
FIG. 1 (Prior Art)
FIG. 1 illustrates a plan view of a typical auction arena in the prior art.
Figure 2:
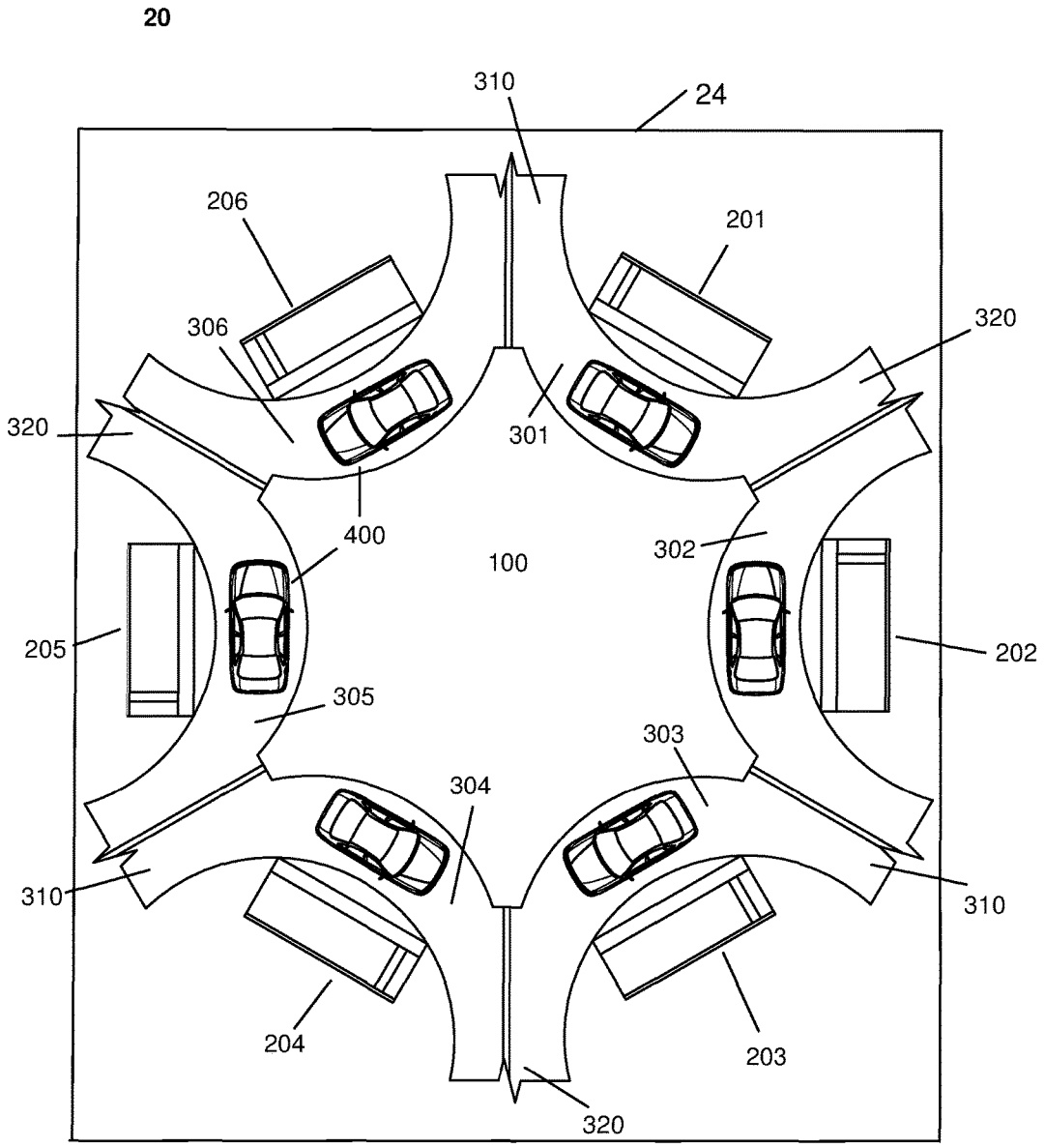
FIG. 2 illustrates a plan view of the improved auto auction arena in its hex arena preferred embodiment.

FIG. 2 illustrates a plan view of the preferred embodiment of the improved auto auction arena. In the preferred embodiment, the improved auto auction arena is configured as a hex arena 20. Before the auction, bidders enter a central bidders' area 100. While the central bidders' area is named for the bidders, in actual operation the central bidders' area will also host consigners and auction house personnel as well as any other people useful to the auction house's operation.

At least three auctioneer stations 201-206 are preferably positioned on elevated platforms outside the central area 100, facing inward. The at least three auctioneer stations 201-206 define a perimeter around the central bidders' area 100. In the preferred embodiment, the perimeter will be embodied with a physical indicator such as a wall, a rope, or a line of paint, but this physical indicator is for convenience only and not necessary to the construction or operation of the improved auto auction arena.

Single-lane paths 301-306 are preferably positioned in the central bidders' area 100 inward of the auctioneer stations 201-206. In the hex arena 20, three approaching two-lane paths 310 enter the arena and fork into one-lane paths 301-306. Said one-lane paths 301-306 curve through the central bidders' area 100 inward from the auctioneer stations 201-206, then merge into departing two-lane paths 320 which exit the hex arena 20. In this embodiment, the approaching two-lane paths 310 and departing two-lane paths 320 alternate with one another; however, the choice of which set of three paths will serve as departing two-lane paths 320 or approaching two-lane paths 310 is an arbitrary decision.

During the auction, one or more cars 400 approach the hex arena 20 single-file by moving along one of the approaching two-lane paths 310. The car 400 is driven along its lane in the two-lane path 310 until said lane forks into a single-lane path 301-306. When the car 400 reaches the designated space corresponding to the appropriate auctioneer station 201-206, the car 400 is brought to rest until all bids are complete and the car 400 is sold. After the auction is complete, the car 400 continues along its single-lane path 301-306, merges onto the appropriate lane of the departing two-lane path 320, and departs the hex arena 20 for its final destination.

Figure 3:
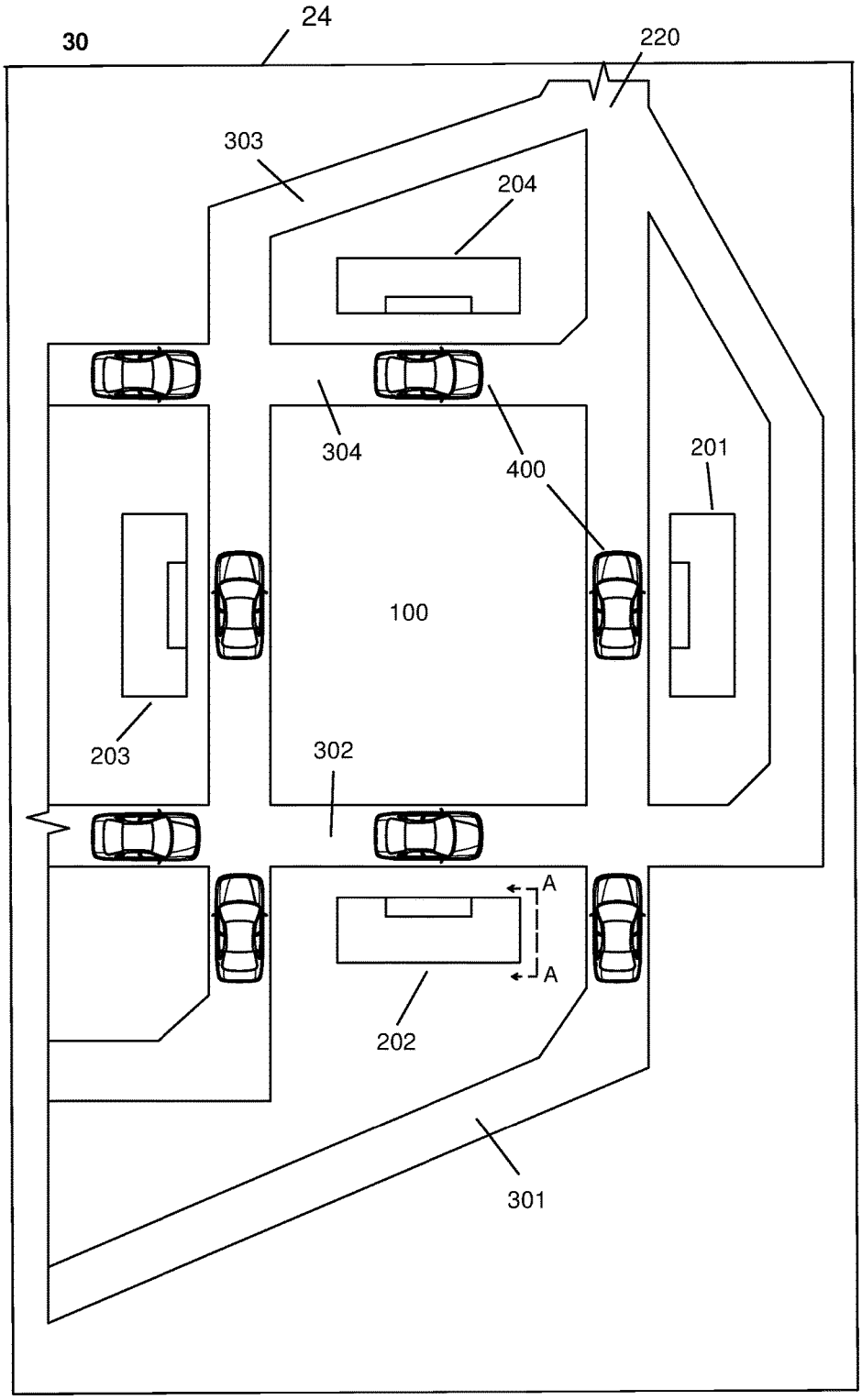
FIG. 3 illustrates a plan view of the improved auto auction arena in its square arena alternate embodiment.
Figure 4:
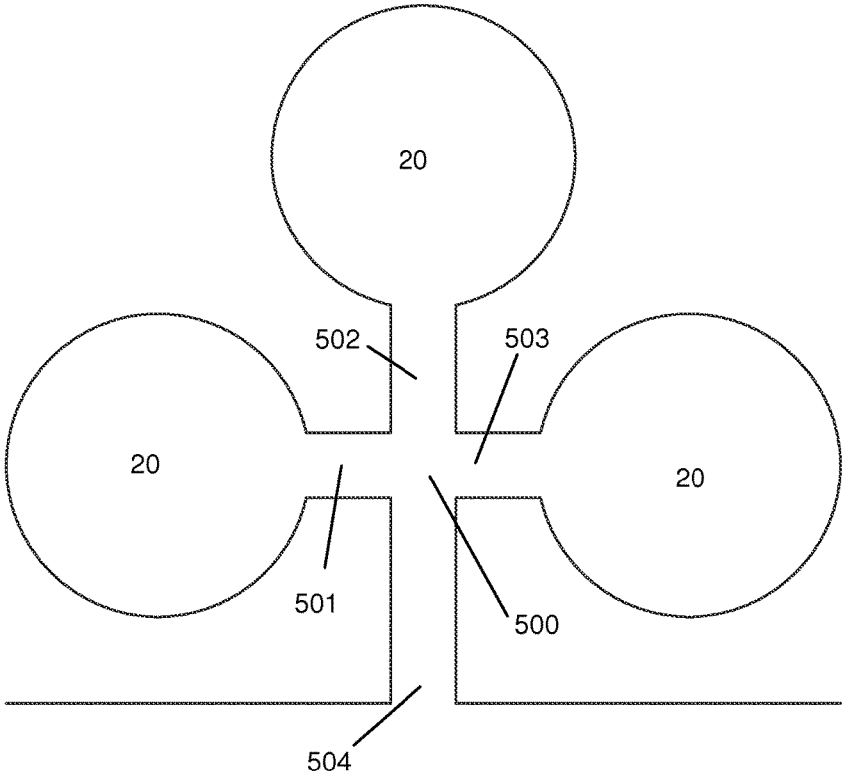
FIG. 4 illustrates an alternate embodiment comprising three hex arenas placed adjacent to one another.
Figure 5:
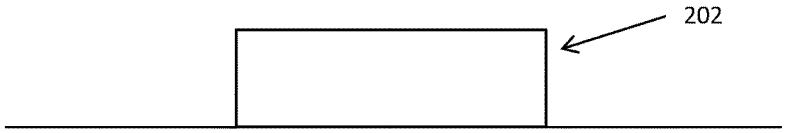
FIG. 5 illustrates a side view A-A from FIG. 3 of auctioneer station 202.

As shown in FIGS. 2 and 3, the bidders' area is open. Having an open central bidders' area 100 enables bidders, consigners, and others within said central bidders' area 100 to see (or "view") every car 400 up for auction. In other words, a person located anywhere in the central bidders' area 100 can see all of the auctioneer stations (201-206). In this configuration, bidders can choose which auctioneer station 201-206 to stay closest to, and even interact with multiple auctioneer stations 201-206. In this embodiment, the single lane paths 301-306 and two-lane paths 310 intersect the perimeter of the central bidders' area 100, curve around the auctioneer stations 201-206, and then cross the perimeter of the central bidders' area 100 once again before exiting the hex arena 20.

Preferably, the hex arena 20 is enclosed within a walled structure 24. This keeps out the rain, allows the auction to use air conditioning, and otherwise makes the hex arena 20 a more hospitable environment. Two-lane paths 310 then preferably and exit the structure 24 through doors large enough to permit two cars 400 to pass at a time. As the auction progresses, cars 400 will enter and exit the hex arena 20 along the appropriate two-lane paths 310, follow the appropriate single lane paths 301-306 to the vicinity of the auctioneer stations 201-206, then follow the appropriate single lane paths 301-306 to the next two-lane path 310 and exit the hex arena 20.

FIG. 3 illustrates a plan view of an alternate embodiment of the improved auto auction arena. This alternative embodiment of the present invention is the square arena 30. A central bidders' area 100 in this embodiment is a rectangular shape, preferably a square, comprising borders collinear with single-lane paths 301-304. Each single-lane path 301-304 runs in close proximity to a corresponding auctioneer station 201-204. Said auctioneer stations 201-204 are preferably placed outside of the central bidders' area 100 on elevated platforms facing inward. This embodiment does away with two-lane paths altogether, exclusively using single-lane paths 301-304 or other paths with only a single lane. After departing the immediate vicinity of the square arena 30, the single-lane paths 301-304 preferably merge onto a departing path 220 which exits the vicinity of the square arena 30. As in the hex arena 20 embodiment, bidders congregate in the central bidders' area 100 where they can see every car 400 up for auction and interact with every auctioneer platform 201-204.

Like the hex arena 20 embodiment, the square arena 30 is configured to enable bidders and consigners to monitor the progress of multiple auctions simultaneously, or even to participate in multiple auctions. In this embodiment, the single-lane paths 301-304 preferably intersect with the perimeter of the central bidders' area 100 at one of its corners, run collinear to the perimeter to the next corner, and then exit the square arena 30.

Further alternative embodiments may use more or fewer paths than those described, but never less than three. It is preferred but not required that the paths completely enclose the central area 100 in order to maximize the efficient use of space. Alternate embodiments may forgo maximal efficiency for economic, aesthetic, or other reasons and leave part of the central bidder's area unenclosed by car paths. Further alternate embodiments may choose to place the arenas outdoors rather than indoors either due to a favorable climate or for economic reasons.

Yet further alternative embodiments expand total auction capacity by expanding the auction house area to comprise multiple arenas. One such embodiment features three hex arenas 20 in a three-point multi-arena configuration 40. In this embodiment, the three arenas further comprise external paths 501-503 leading to an intersection 500, the intersection 500 further comprising an exit path 504 leading away from the hex arenas 20; the three hex arenas 20 and the exit path 504 are configured perpendicular to each other at this intersection. Each hex arena 20 comprises the features previously described herein. This multi-arena configuration 40 enables the arena operators to sort cars 400 up for auction according to chosen criteria such as manufacturer or price floor. In this multi-arena configuration 40, the auto lanes preferably do not fully enclose each hex arena 20; instead, one portion of a side comprises an external path 501-503 leading to the intersection.

While embodiments of the disclosure have been described in terms of various specific embodiments, those skilled in the art will recognize that the embodiments of the disclosure may be practiced with modifications within the spirit and scope of the claims.

What is claimed is:

1. An improved arena for conducting auctions, the arena comprising, a central bidders' area, a first auctioneer station, a second auctioneer station, a third auctioneer station, a fourth auctioneer station, a fifth auctioneer station, and a sixth auctioneer station spaced around the central bidders' area so that all of the auctioneer stations can be viewed from anywhere in the central bidders' area, a first automobile lane located between the first auctioneer station and the central bidders' area, a first side of the first automobile lane adjacent to the first auctioneer station and a second side of the first automobile lane adjacent to the central bidders' area, the first and second sides of the first automobile lane oriented parallel to a first direction of travel in the first automobile lane, a second automobile lane located between the second auctioneer station and the central bidders' area, a first side of the second automobile lane adjacent to the second auctioneer station and a second side of the second automobile lane adjacent to the central bidders' area, the first and second sides of the second automobile lane oriented parallel to a second direction of travel in the second automobile lane, a third automobile lane located between the third auctioneer station and the central bidders' area, a first side of the third automobile lane adjacent to the third auctioneer station and a second side of the third automobile lane adjacent to the central bidders' area, the first and second sides of the third automobile lane oriented parallel to a third direction of travel in the third automobile lane, a fourth automobile lane located between the fourth auctioneer station and the central bidders' area, a first side of the fourth automobile lane adjacent to the fourth auctioneer station and a second side of the fourth automobile lane adjacent to the central bidders' area, the first and second sides of the fourth automobile lane oriented parallel to a fourth direction of travel in the fourth automobile lane, a fifth automobile lane located between the fifth auctioneer station and the central bidders' area, a first side of the fifth automobile lane adjacent to the fifth auctioneer station and a second side of the fifth automobile lane adjacent to the central bidders' area, the first and second sides of the fifth automobile lane oriented parallel to a fifth direction of travel in the fifth automobile lane, a sixth automobile lane located between the sixth auctioneer station and the central bidders' area, a first side of the sixth automobile lane adjacent to the sixth auctioneer station and a second side of the sixth automobile lane adjacent to the central bidders' area, the first and second sides of the sixth automobile lane oriented parallel to a sixth direction of travel in the sixth automobile lane.

2. The arena of claim 1, the arena further comprising a walled structure, the walled structure enclosing the central bidders' area and the first, second, third, fourth, fifth, and sixth auctioneer stations.

3. The arena of claim 1 wherein the first automobile lane is at least five feet wide.

4. The arena of claim 1, the central bidders' area further comprising a first surface upon which bidders can stand and the first auctioneer station comprising a second surface upon which an auctioneer can stand, the second surface above the first surface.

5. The arena of claim 1 further comprising a perimeter around the central bidders' area, the perimeter created by the first, second, third, fourth, fifth and sixth automobile lanes.

6. The arena of claim 1 further comprising a first approaching two-lane path, the first approaching two-lane path consisting of the first and second automobile lanes oriented parallel and adjacent to each other, the first approaching two-lane path splitting into two single lanes at a fork so that after the fork, the first and second automobile lanes are separated, only the first automobile lane passes next to the first auctioneer station, and only the second automobile lane passes next to the second auctioneer station.

* * * * *